United States Patent [19]

Beckenbaugh et al.

[11] 4,228,213

[45] Oct. 14, 1980

[54] METHOD OF DEPOSITING A STRESS-FREE ELECTROLESS COPPER DEPOSIT

[75] Inventors: William M. Beckenbaugh, East Amwell Township, Hunterdon County; Kim L. Morton, Delaware Township, Hunterdon County, both of N.J.

[73] Assignee: Western Electric Company, Inc., New York, N.Y.

[21] Appl. No.: 65,807

[22] Filed: Aug. 13, 1979

Related U.S. Application Data

[60] Division of Ser. No. 956,946, Nov. 2, 1978, Pat. No. 4,167,601, which is a continuation-in-part of Ser. No. 741,639, Nov. 15, 1976, abandoned.

[51] Int. Cl.[2] ..... B32B 3/10; C23C 3/02

[52] U.S. Cl. ..... 428/209; 106/1.18; 204/38 B; 427/97; 427/98; 427/305; 427/306; 428/210; 428/432; 428/457

[58] Field of Search ..... 428/209, 210, 901, 432, 428/457; 106/1.18; 204/38 B; 427/97, 98, 305, 306

[56] References Cited

U.S. PATENT DOCUMENTS

| | | | |
|---|---|---|---|
| 2,938,805 | 5/1960 | Agens | 106/1.18 |
| 3,011,920 | 12/1961 | Shipley | 106/1.18 |
| 3,119,709 | 1/1964 | Atkinson | 106/1.18 |
| 3,383,224 | 5/1968 | Dutkewych | 106/1.18 |
| 3,475,186 | 10/1969 | Dutkewych | 106/1.18 |
| 3,485,643 | 12/1969 | Zeblisky | 106/1.18 |
| 3,532,518 | 10/1970 | D'Ottavio | 106/1 |
| 3,615,732 | 10/1971 | Shipley | 106/1.18 |
| 3,615,735 | 10/1971 | Shipley | 106/1.18 |
| 3,649,308 | 3/1972 | Gulla | 106/1.18 |
| 3,663,242 | 5/1972 | Gulla | 106/1.18 |
| 3,758,314 | 9/1973 | Haack | 106/1.18 |
| 3,765,936 | 10/1973 | Shipley | 174/68.5 |
| 3,772,056 | 11/1973 | Polichette | 428/320 |
| 3,772,078 | 11/1973 | Polichette | 427/249 |
| 3,907,621 | 9/1975 | Polichette | 156/18 |
| 3,925,578 | 12/1975 | Polichette | 427/304 |
| 3,930,963 | 1/1976 | Polichette | 204/15 |
| 4,084,023 | 4/1978 | Dafter | 427/98 |
| 4,098,922 | 7/1978 | Dinella | 427/54 |

FOREIGN PATENT DOCUMENTS 1203131 8/1970 United Kingdom .

*Primary Examiner*—Ellis P. Robinson
*Attorney, Agent, or Firm*—Joel F. Spivak

[57] ABSTRACT

A method of depositing a stress-free electroless copper deposit is disclosed. The method comprises contacting a catalyzed surface with a solution comprising a source of cupric ions; a reducing agent for the cupric ions; a complexing agent for the solution selected from (a) ethylenediaminetetraacetic acid, (b) a salt of (a), (c) a modified ethylenediamine acetic acid, (d) a salt of (c), and (e) a mixture of at least two of the foregoing complexing agents; a stabilizer for the solution comprising a mercury compound; and an accelerator for the solution comprising a water-soluble compound containing a cyanide radical ($CN^-$) complexed with a metal selected from Group VIII of the Periodic Table of the Elements.

41 Claims, No Drawings

METHOD OF DEPOSITING A STRESS-FREE ELECTROLESS COPPER DEPOSIT

This is a division of application Ser. No. 956,946, filed Nov. 2, 1978, now U.S. Pat. No. 4,167,601, which is a continuation-in-part of application Ser. No. 741,639, filed Nov. 15, 1976, now abandoned.

TECHNICAL FIELD

This invention relates to a method of depositing copper metal on a surface and more particularly, to a method of depositing an essentially stress-free electroless copper deposit.

BACKGROUND OF THE INVENTION

There are a great number of electroless copper deposition solutions currently employed. However, electroless copper deposits obtained from these solutions have some inherent stress (tensile or compressive). For printed circuit manufacture, an electroless copper deposit which is stress free is desirable. This is especially desirable for the so-called flexible printed circuits which require a certain degree of flexure.

Recently, methods have been reported in which electroless copper deposits can be applied to a broad variety of insulating substrate surfaces without the use of expensive noble metals but on the contrary, employ reducible salt compositions of non-noble metals. U.S. Pat. Nos. 3,772,056; 3,772,078; 3,907,621; 3,925,578; and 3,903,963 disclose such methods. A problem with the methods disclosed in these patents is that immersion in or treatment with a conventional electroless copper solution leads to at least partial destruction of a catalytic real image formed on the insulative surface unless the initiation time of the electroless copper deposition is rapid. It has been found that most electroless copper deposition baths or solutions do not have a rapid enough initiation rate.

An electroless copper deposition solution is currently commercially available and contains a source of cupric ions, i.e., cupric sulfate, a formaldehyde reducing agent, a phenyl mercuric acetate stabilizer, a mercuric acetate stabilizer, a potassium ferrocyanide accelerator and a complexing agent comprising N, N, N', N' tetrakis-(2-hydroxypropyl)-ethylenediamine

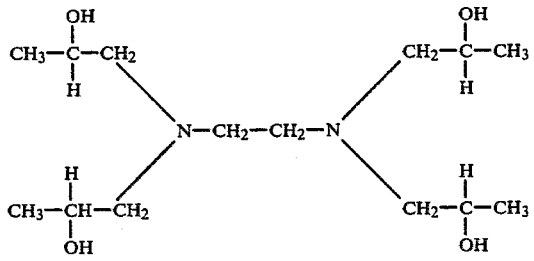

The copper deposit obtained with such a solution has been found to contain stresses. The initiation rate of such a solution is rapid, but a more rapid initiation rate is desirable.

SUMMARY OF THE INVENTION

This invention relates to a method of depositing copper metal on a surface and more particularly, to a method of depositing a stress-free electroless copper deposit.

The method comprises contacting a catalyzed surface with a solution comprising a source of cupric ions; a reducing agent for the cupric ions; a complexing agent for the solution selected from the group consisting of (a) an ethyleneamine acetic acid, (b) a salt of (a), and (c) a mixture of at least two of the foregoing complexing agents; a stabilizer for the solution comprising a mercury compound; and an accelerator for the solution comprising a water-soluble compound containing a cyanide radical ($CN^-$) complexed with a metal selected from Group VIII of the Periodic Table of the Elements.

DETAILED DESCRIPTION

The present invention will be discussed primarily in terms of depositing a stress-free copper deposit on a surface of a dielectric substrate used as a printed circuit board. It will be readily appreciated that the essentially stress-free copper deposition is not limited to any one particular type of surface but it applicable to copper metallizing any surface whether used in a printed circuit board or not.

Stress-free electroless copper deposits are desirable for printed wiring boards, especially for flexible printed wiring boards. Also, where metallization is desirable through radiant energy exposure as described in U.S. Pat. Nos. 3,772,056; 3,772,078; 3,907,621; 3,925,578; and 3,930,963, all of which are incorporated hereinto by reference, a rapid initiation rate of the electroless copper deposition solution is needed.

A commercial electroless metal deposition solution is available which comprises cupric sulfate, formaldehyde, phenyl mercuric acetate, mercuric acetate, potassium ferrocyanide and N, N, N', N' tetrakis-(2-hydroxypropyl)-ethylenediamine. It has been found that the copper deposit obtained with this solution has stress, i.e., it is not stress free. Surprisingly and unexpectedly, the electroless copper deposition solution of the present invention yields an essentially stress-free copper deposit at an initiation rate which is synergistically greater than the above-described commercial electroless copper solution, namely about 400 percent greater.

The present invention is predicated upon the discovery of the synergistic effect obtained by combining, in an electroless copper solution, (1) a complexing agent selected from the group consisting of an ethyleneamine acetic acid or a salt thereof or a mixture of at least two of the foregoing complexing agents, (2) mercury compound stabilizer, and (3) an accelerator comprising a water-soluble compound containing a cyanide radical ($CN^-$) complexed with a metal selected from Group VIII of the Periodic Table of Elements.

An aqueous solution is first prepared. The aqueous solution comprises (a) a source of cupric ions, e.g., cupric sulfate, cupric acetate, etc.; (b) a reducing agent for the cupric ions, e.g., formaldehyde, paraformaldehyde, dimethoxylhydantoin, glyoxal, alkali metal borohydrides, boranes, etc.; and (c) a basic pH adjuster to provide the required pH, e.g., NaOH, KOH, etc. To the aqueous solution is added or dissolved the complexing agent, stabilizer and accelerator to form the resultant electroless copper deposition solution.

Suitable complexing agents include ethyleneamine acetic acid derivatives and salts thereof, e.g., ethylenediaminetetraacetic acid and the sodium mono-, di-, tri- tetrasodium salts thereof, modified ethylenediamine acetic acids or their salts such as N-hydroxyethylenediamine-triacetic acid or the mono-, di- or trisodium salt thereof, cyclohexandiaminetetraacetic acid or its respective salts, and diethylenetriaminepentaacetic acid and its respective salts. The complexing agent serves to complex the copper ion so that it will not be precipitated from the electroless copper solution, e.g., by hydroxyl ions and the like, and at the same time makes the copper ions available as needed to the reducing action of the reducing agent. The complexing agent is present in the resultant electroless copper deposition solution in an amount sufficient to accomplish the purpose described. Typically, the complexing agent is present in the resultant electroless copper solution in an amount ranging from 3 to 6 weight percent of the resultant solution.

A suitable mercury compound stabilizer includes a first mercury compound which is capable, upon dissolving in the aqueous solution, of providing a small but effective amount of a source of mercury ions to improve the stability of the resultant electroless copper deposition solution without retarding the rate of deposition. Such first mercury compounds are described in U.S. Pat. No. 3,663,242, incorporated hereinto by reference, and include in part, mercuric acetate, mercuric benzoate, mercuric bromide, mercurous chloride, mercuric carbonate, mercuric chlorate, mercuric iodate, mercurous nitrate, mercuric nitrate, mercuric sulphate and mercuric ammonium chloride. A particularly effective compound is mercuric chloride.

The first mercury compound may be present in the resultant electroless copper deposition solution in trace amounts and preferably is present in amounts ranging from 1 part to 100 parts per million parts of the electroless copper deposition solution. It may also be present in amounts up to saturation.

Another suitable mercury compound stabilizer includes a second mercury compound which is a covalent mercury compound. Such covalent mercury compounds are described in U.S. Pat. No. 3,649,308, incorporated hereinto by reference, and include, in part, a mercury compound represented by the formula R—Hg—R′, where R represents a radical such as alkyl including cycloalkyl, aryl, alkaryl, aralkyl, alkoxy, aryloxy, heterocyclic and the like, and R′ represents the same radicals as R and in addition polar groups such as —$NO_2$, —$SO_2OH$, and metal salts such as sodium salts, —COOH and metal salts such as sodium salts, —$NH_2$, halides such as —Cl, —Br, and —I, —CN and the like. Examples of compounds corresponding to the above formula include ethylmercuric hydroxide, ethylmercuric iodide, mercury ethylmercaptide (ic), mercury phenylmercaptide (ic), methylmercuric chloride, methylmercuric iodide, diisopropylmercury, dimethylanilinemercury (p), dimethylmercury, dinaphthylmercury ($\alpha$), dinaphthylmercury ($\beta$), dipropylmercury, ditolylmercury (o), ditolylmercury (m), ditolylmercury (p), phenylmercuric bromide, phenylmercuric chloride, phenylmercuric cyanide, phenylmercuric iodide, phenylmercuric nitrate, tolylmercuric bromide (p), biphenylmercury, chloromercuriphenol (o), di-n-amylmercury, di-(di)amylmercury, dibenzylmercury, di-n-butylmercury, di-n-hexylmercury, diisoamylmercury, diidobutylmercury, the sodium salt of mercuriphenoldisulphamite, the sodium salt of 2,4-dihydroxy-3,5-(di(hydroxymercuri) benzophenone-2′-sulphonate, the sodium salt of 0-[(3-hydroxymercuric-2-methoxypropyl) carbonyl]-phenoxyacetic acid and the like.

Preferably, the covalent mercury compound contains polar groups either attached to the radical R or as represented by R′. These polar groups enhance the solubility of the covalent mercury compounds in solution. Preferred polar groups are —OH and alkali metal salts of —COOH and —$SO_2OH$. A particularly effective covalent mercury compound stabilizer is phenyl mercuric acetate.

The covalent mercury compound stabilizer may be present in the resultant electroless copper deposition solution in trace amounts and is preferably present in an amount ranging from 1 part to 100 parts per million parts of the electroless copper deposition solution.

Of course, the stabilizer may comprise a mixture of the first mercury compound, and the second mercury compound.

Suitable accelerators are water-soluble complex cyano-metallo compounds in which the cyanide radical ($CN^-$) is complexed with certain metals of Group 8 of the Periodic Table of Elements as set forth in the Mendelyeev Periodic Table appearing on page B2 in the 45th edition of the *Handbook of Chemistry and Physics,* published by the Chemical Rubber Company, including mixtures of such compounds. These accelerators are described in U.S. Pat. No. 3,485,643, incorporated hereinto by reference. Typical of such compounds are those in which the cyanide radical ($CN^-$) is complexed with iron, iridium and rhenium, including mixtures of such compounds.

Preferred for use are the water-soluble complex cyano-iron compounds, i.e., hexacyanoferrate (II) and hexacyanoferrate (III) compounds, as well as mixtures of such compounds. Typical of such compounds are the ferricyanides and ferrocyanides of the metals of Groups 1a (alkali metal) and 2a (alkaline earth metal) of the Periodic Table of Elements, referred to above, and ammonium. Preferred for use are the sodium, potassium and ammonium ferricyanides and ferrocyanides. It will be appreciated that in alkaline solutions the ferricyanides will be reduced to ferrocyanides, so that in such solutions the ferrocyanides will function as the accelerator, even though the accelerator is added as a ferricyanide. The accelerators should be added in amounts of between $1.5\times10^{-5}$ moles per liter and $2\times10^{-1}$ moles per liter of electroless copper solution, preferably between about $3\times10^{-4}$ moles per liter and $6\times10^{-3}$ moles per liter of electroless copper solution.

For metallization a suitable substrate is first selected. Typical substrates include bodies comprising inorganic and organic substances, such as glass, ceramics, porcelain, resins, paper cloth and the like. For printed circuits, among the materials which may be used as the base thereof, may be mentioned insulating thermosetting resins, thermoplastic resins and mixtures of the foregoing, including fiber, e.g., fiberglass, impregnated embodiments of the foregoing.

Included in the thermoplastic resins are acetal resins; acrylics, such as methylacrylate; cellulosic resins, such as ethyl cellulose, cellulose acetate, etc.; polyethers; nylon; polyethylene; polystyrene; styrene blends, such as acrylonitrile-butadiene-styrene; polycarbonates; polychlorotrifluoroethylene; vinyl polymers and copolymers, e.g., vinyl chloride; etc.

Among the thermosetting resins may be mentioned allyl phthalate; furan; melamine-formaldehyde; phenol formaldehyde; polyacrylic esters; silicones; urea formaldehydes; epoxy resins; allyl resins; polyesters; etc.

Porous materials comprising paper, wood, fiberglass, cloth and fibers, such as natural and synthetic fibers, e.g., cotton fibers, polyester fibers and the like, as well as such materials themselves, may also be metallized in accordance with the teachings herein. The invention is applicable to the metallization of resin-impregnated fibrous structures and varnish-coated, resin-impregnated fiber structures of the type described.

A surface of the selected substrate is sensitized, using any conventional technique, whereby a catalytic species, e.g., an activating metal such as Pd, Pt, Ag, Au, etc., is deposited thereon, which catalytic species is capable of catalyzing the electroless plating reaction once the surface is introduced into the resultant electroless copper deposition solution of the present invention. Typically, the sensitization is carried out by treating the surface with a solution containing $Sn^{+2}$ ions or a colloidal species thereof. Next the solution is exposed to a suitable activating solution containing the activating species, e.g., $Pd^{+2}$, wherein the activating species, e.g., $Pd^{+2}$, is reduced to the metal, e.g., $Pd^{o}$, which in turn is deposited on the surface. Such sensitizing procedures may be found, in part, in *Metallic Coating of Plastics,* William Goldie, Electrochemical Publications, 1968.

The surface can also be sensitized utilizing the so-called "one-step activators," typical examples of which are revealed in U.S. Pat. Nos. 3,011,920 and 3,532,518.

U.S. Pat. Nos. 3,772,056; 3,772,078; 3,907,621; 3,925,578; and 3,930,963 disclose sensitizing the surface by coating the surface with a composition comprising at least a reducible salt of a non-noble metal selected from copper, nickel, cobalt or iron. The reducible salt is then converted, by exposure to a source of radiant energy, to electrically non-conductive metal species nuclei, believed to be metal nuclei, capable of catalyzing the deposition thereon of a metal from an electroless metal deposition solution. However, it has been found that in using this method the electroless metal deposition solution should have a rapid deposition initiation rate (as differentiated from the overall reaction or deposition rate). If the electroless metal deposition initiation rate is not rapid, i.e., the amount of deposit is not high, e.g., 0.4 to 2$\mu$ inches per minute as measured within 15 seconds, then the resultant electroless metal deposit is discontinuous and non-uniform.

Surprisingly and unexpectedly, it has been found that the combination of the complexing agent, stabilizer and accelerator, described above, leads to an initiation rate which is extremely rapid. The initiation rate is about 400 percent more rapid than the commercially available electroless copper solution containing $CuSO_4$, $$\overset{O}{\overset{\|}{HC}}-H,$$

phenyl mercuric acetate, mercuric acetate, $K_4Fe(CN)_6$, and N, N, N′, N′ tetrakis-(2-hydroxypropyl)-ethylenediamine. Surprisingly and unexpectedly, the electroless copper deposit obtained with the resultant electroless copper deposition solution is essentially stress free whereas the copper deposits obtained with other solutions, including the particular commercially available one, described above, are not.

The electroless copper deposit may be built up to a desired thickness by prolonged exposure to the electroless copper deposition solution, or, alternatively, may be further built up by being electroplated in a standard electroplating bath. The various typical electroplating solutions, plating conditions and procedures are well known in the art and will not be elaborated herein.

It is of course to be understood that the electroless copper metallization may be done selectively to obtain a pattern, utilizing conventional techniques, e.g., masking, selective radiation exposure, etc., or the substrate surface may first be blanket metallized followed by conventional subtractive techniques, e.g., masking and etching.

EXAMPLE I

A. A substrate comprising a steel core with a fully cured diglycidyl ether of bisphenol A coating thereon was selected. The substrate was immersed in a solvent bath comprising methyl ethyl ketone for ten minutes at 25° C. The substrate was water rinsed for one minute at 25° C. and then etched in an aqueous solution comprising 360 grams $CrO_3$, 250 grams $H_3PO_4$ and 180 grams $H_2SO_4$ in 1000 ml. of water, maintained at 25° C. for ten minutes. The etched substrate was then water rinsed at 25° C. for ten minutes.

A sensitizing solution was prepared by dissolving 21.5 grams of cupric formate, 16 grams of 2,6-anthraquinone disulfonic acid disodium salt, 50 ml. of butanol and 66 grams of sorbitol in a solvent comprising 950 ml. of $H_2O$. The etched substrate was immersed in the sensitizing solution for one minute at 25° C., removed therefrom and dried at 90° to 100° C. for three minutes. A surface of the dried substrate was selectively exposed to a high-pressure mercury discharge lamp (30 watts/cm$^2$ surface at 3660A.) for 90 seconds to form a real image, comprising a copper species, capable of catalyzing the deposition of a metal from an electroless metal deposition solution. The imaged surface was then water rinsed at 25° C. for 2 minutes.

For comparison purposes, a commercially obtained aqueous electroless copper deposition solution, containing 0.06 mole of $CuSO_4.5H_2O$, 0.26 mole of formaldehyde, 0.45 mole of NaOH, 0.006 mole of $K_4Fe(CN)_6$, 0.063 mole of N, N, N′, N′ tetrakis-(2-hydroxypropyl)-ethylenediamine, 3 parts of phenyl mercuric acetate per million parts of the electroless solution and 11 parts of mercuric acetate per million parts of the electroless solution, was selected. The imaged and rinsed surface was immersed in the electroless plating solution (maintained at 55° C.) and the initiation rate of deposition of metallic copper was determined after 15 seconds to be 0.38$\mu$ inch/minute. An overall plating rate of 3.5$\mu$ inches/minute was observed after 5 minutes.

B. For comparison purposes, the procedure of Example I-A was repeated except that a second commercially obtained aqueous electroless copper deposition solution was employed. The electroless copper deposition solution comprised 0.052 mole $CuSO_4.5H_2O$, 0.3 mole formaldehyde, 0.37 mole NaOH, 0.1 mole N, N, N′, N′ tetrakis-(2-hydroxypropyl)-ethylenediamine, 20 parts of KCN per million parts of the electroless copper solution and 1.2 parts of $Na_2S_2O_3.5H_2O$ per million parts of the electroless copper solution. The initiation deposition rate after 15 seconds was negative since the real image was being partially dissolved in the electroless copper deposition solution and no electroless copper deposit was obtained. An overall plating rate (discontinuous deposit) of 3.4$\mu$ inches/minute was obtained after 5 minutes.

C. For comparison purposes, the procedure of Example I-A was repeated except that a third commercially obtained aqueous electroless copper deposition solution was employed. The solution comprised 0.06 mole of $CuSO_4.5H_2O$, 0.12 moles of formaldehyde, 0.1 moles of NaOH, 0.15 mole of the tetrasodium salt of ethylenediaminetetraacetic acid, 10 parts of NaCN per million parts of the electroless solution and 10 parts of 2-mercaptobenzothiazole per billion parts of the electroless solution. The imaged and rinsed surface was immersed in the electroless copper solution which was maintained at 72° C. The initiation rate of deposition of metallic copper was determined after 15 seconds to be 1.8μ inches/minute. This is an anomalous result which is unexplainable except for the difference in plating temperature (72° C. as compared to 55° C.), since the deposition rate proceeded to peak very quickly and then slow down dramatically as evidenced by the overall deposition rate of 1.0μ inch/minute after 10 minutes.

D. The procedure of Example I-A was repeated except that an aqueous electroless copper deposition solution comprising 0.064 mole of $CuSO_4.5H_2O$, 0.47 mole formaldehyde, about 0.32 mole of NaOH, 0.15 mole of the tetrasodium salt of ethylenediaminetetraacetic acid (EDTA), 0.0048 mole of $K_4Fe(CN)_6.3H_2O$ and 20 parts of phenyl mercuric acetate per million parts of the resultant electroless copper deposition solution, was prepared and used. The imaged and rinsed surface was immersed in the electroless copper solution, maintained at 55° C., and the initiation rate of the deposition of metallic copper was determined after 15 seconds to be 1.6μ inches/minute. This is about a 400 percent increase over the initiation rate of Example I-A. The overall reaction rate was 5.0μ inches/minute after 5 minutes.

E. The procedure of Example I-D was repeated except that 0.15 mole of the trisodium salt of 2-hydroxyethyl ethylenediaminetriacetic acid dihyrate (HEEDTA) replaced the EDTA in the deposition solution of Example I-D.

F. The procedure of Example I-D was repeated except that 0.15 moles of the tetrasodium salt of cyclohexanediaminetetraacetic acid dihydrate (CDTA) replaced the EDTA in the deposition solution of Example I-D.

G. The procedure of Example I-D was repeated except that 0.15 mole of the pentasodium salt of diethylenetriaminepentaacetic acid (DTPA) replaced the EDTA in the deposition solution of Example I-D.

EXAMPLE II

A. For comparison, the stress of an electroless copper deposit obtained with the electroless copper deposition solution of Example I-A was measured. A spiral contractometer similar in design to that described by F. B. Koch et al., *Plating and Surface Finishing,* January 1976, 46–51, was employed. The described contractometer was modified to include a rotary variable differential transducer in which the output voltage varied with rotation in either direction from a null point. A 15 mil thick copper helix was immersed in the solution of Example I-A (maintained at 35° C.) and after 15 seconds electroless copper was initiated. After 10 minutes of plating the helix a compressive stress of 8000 psi was measured.

B. For comparison purposes, the procedure of Example II-A was repeated with the solution of Example I-B. After 10 minutes of plating the helix a compressive stress of 15,400 psi was measured.

C. For comparison purposes, the procedure of Example II-A was repeated with the solution of Example I-C. After 10 minutes of plating the helix a compressive stress of 11,500 psi was measured.

D. The procedure of Example II-A was repeated with the solution of Example I-D. Plating began after 15 seconds, and, after 10 minutes of plating the helix, no stress, either compressive or tensile, was measured within the resolution of the contractometer. This is a surprising and unexpected result for which there is no explanation at the present time.

E. The procedure of Example II-A was repeated with the solution of Example I-E.

F. The procedure of Example II-A was repeated with the solution of Example I-F.

G. The procedure of Example II-A was repeated with the solution of Example I-E through I-G.

The results of Examples II-D through II-F are shown in the following Table.

| | Stress psi (comp) | Initiation rate after 15 sec., μin./min. | Overall plating rate over 10 min., μin./min. |
|---|---|---|---|
| EDTA | 0 | 1.6 | 5.0 |
| DTPA | 750 | 0.65 | 3.2 |
| HEEDTA | 800 | 1.92 | 12.0 |
| CDTA | 400 | 0.15 | 10.0 |

It is to be understood that the above-described embodiments are simply illustrative of the principles of the invention. Various other modifications and changes may be made by those skilled in the art which will embody the principles of the invention and fall within the spirit and scope thereof. It should be further understood that the term essentially stress free means films which show no stress or stress within the sensitivity limits and experimental error of the measurement technique employed. Based upon such limits, films having measured stress of less than about 1,000 psi are considered essentially stress free.

It can be seen that only use of the solutions of Example I-D through I-G, namely the novel solutions, results in the combination of essentially stress-free deposits, high initiation rate and good overall deposition rate.

What is claimed is:

1. A method of depositing a stress-free copper deposit on a surface which comprises contacting a catalyzed surface with a solution comprising:
   (a) a source of cupric ions;
   (b) a reducing agent for said cupric ions;
   (c) a complexing agent for the solution selected from the group consisting of (1) cyclohexendiaminetetraacetic acid, (2) a salt of (1), and (3) a mixture of the foregoing complexing agents;
   (d) a stabilizer for the solution comprising a mercury compound; and
   (e) an accelerator for the solution comprising a water soluble compound containing a cyanide radical complexed with a metal selected from Group VIII of the Periodic Table of the Elements.

2. The method as defined in claim 1 wherein said accelerator compound contains a radical selected from the group consisting of hexacyanoferrate (II), hexacyannoferrate (III), and mixtures thereof.

3. The method as defined in claim 1 wherein said accelerator is present in an amount ranging from about $1.5\times10^{-5}$ to about $1.2\times10^{-1}$ moles per liter of the solution, calculated as the metal with which the cyanide radical is complexed.

4. The method as defined in claim 1 wherein said accelerator comprises a metal selected from the group consisting of iron, iridium and rhenium.

5. The method as defined in claim 1 wherein said reducing agent comprises formaldehyde.

6. The method as defined in claim 1 wherein said accelerator compound is in the form of a salt of a member selected from the group consisting of alkali metal, alkaline earth metal and ammonium.

7. The method as defined in claim 1 wherein said mercury compound is one selected from the group consisting of ($a^1$) a mercury compound capable of providing a source of mercury ions in the solution; ($b^1$) a covalent mercury compound corresponding to the formula R—Hg—R', where R is a covalently bonded organic radical selected from the group of alkyl, cycloalkyl, aryl, alkaryl, aralalkyl, alkoxy, aryloxy, and heterocyclic radicals and R' is the same as R or a polar group selected from the groups of —$NO_2$, —$SO_2OH$ and alkali metal salts thereof, —COOH and alkali metal salts thereof, —$NH_2$, —$CN_1$ and halide; ($c^1$) phenyl mercuric acetate; and ($d^1$) a mixture comprising at least two of the foregoing.

8. The method as defined in claim 7 wherein in ($a^1$) said R' is a polar group.

9. The method as defined in claim 7 wherein said compound in ($b^1$) or ($c^1$) is present in an amount ranging from 1 to 100 parts per million parts of the solution.

10. The method as defined in claim 7 wherein said compound in ($a^1$) is present in an amount ranging from at least one part per million parts of the solution to saturation of the solution.

11. The method as defined in claim 1 wherein said stabilizer is selected from the group consisting of mercuric chloride and phenyl mercuric acetate.

12. The method as defined in claim 1, wherein:

said reducing agent comprises formaldehyde, and said accelerator comprises potassium ferrocyanide.

13. A method of rendering an electroless copper deposition solution capable of having deposited therefrom a stress-free copper deposit which comprises combining in the solution:

(a) a complexing agent for the solution selected from the group consisting of (1) cyclohexendiaminetetraacetic acid, (2) a salt of (1), and (3) a mixture of the foregoing complexing agents;

(b) a stabilizer for the solution comprising a mercury compound; and (c) an accelerator for the solution comprising a water-soluble compound containing a cyanide radical complexed with a metal selected from Group VIII of the Periodic Table of the Elements.

14. The method as defined in claim 13 wherein:

said mercury compound is one selected from the group consisting of ($a^1$) a first mercury compound capable of providing a source of mercury ions in the solution; ($b^1$) a covalent mercury compound corresponding to the formula R—Hg—R', where R is a covalently bonded organic radical selected from the group of alkyl, cycloalkyl, aryl, alkaryl, aralalkyl, alkoxy, aryloxy, and heterocyclic radicals and R' is the same as R or a polar group selected from the groups of —$NO_2$, —$SO_2OH$ and alkali metal salts thereof, —COOH and alkali metal salts thereof, —$NH_2$; —CN and halide; ($c^1$) phenyl mercuric acetate; and ($d^1$) a mixture comprising at least two of the foregoing; and said accelerator compound contains a radical selected from the group consisting of hexacyanoferrate (II), hexacyannoferrate (III), and mixtures thereof.

15. The method as defined in claim 13 wherein:

said stabilizer is selected from the group consisting of mercuric chloride and phenyl mercuric acetate, and said accelerator compound comprises potassium ferrocyanide.

16. An aqueous electroless plating solution capable of depositing therefrom an essentially stress-free copper deposit comprising:

(c) a source of cupric ions;

(b) a reducing agent for said cupric ions;

(c) a complexing agent for the solution selected from the group consisting of (1) cyclohexendiaminetetraacetic acid, (2) a salt of (1), and (3) a mixture of the foregoing complexing agents;

(d) a stabilizer for the solution comprising a mercury compound; and (e) an accelerator for the solution comprising a water-soluble compound containing a cyanide radical complexed with a metal selected from Group VIII of the Periodic Table of Elements.

17. The solution as defined in claim 16 wherein the accelerator compound contains a radical selected from the group consisting of hexacyanoferrate (II), hexacyannoferrate (III), and mixtures thereof.

18. The solution as defined in claim 16 wherein said accelerator is present in an amount ranging from about $1.5\times10^{-5}$ to about $1.2\times10^{-1}$ moles per liter of the solution, calculated as the metal with which the cyanide radical is complexed.

19. The solution as defined in claim 16 wherein the metal is selected from the group consisting of iron, iridium and rhenium.

20. The solution as defined in claim 16 wherein said reducing agent comprises formaldehyde.

21. The solution as defined in claim 17 wherein said accelerator compound is in the form of a salt of a member selected from the group consisting of alkali metal, alkaline earth metal and ammonium.

22. The solution as defined in claim 16 wherein said mercury compound is one selected from the group consisting of ($a^1$) a covalent mercury compound corresponding to the formula R—Hg—R', where R is a covalently bonded organic radical selected from the group of alkyl, cycloalkyl, aryl, alkaryl, aralalkyl, alkoxy, aryloxy, and heterocyclic radicals and R' is the same as R or a polar group selected from the groups of —$NO_2$, —$SO_2OH$ and alkali metal salts thereof, —COOH and alkali metal salts thereof, —$NH_2$, —CN and halide; ($b^1$) phenyl mercuric acetate; ($c^1$) a mercury compound capable of providing mercury ions in the solution; and ($d^1$) a mixture of at least two of the foregoing mercury compounds.

23. The solution as defined in claim 22 wherein in ($a^1$) said R' is a polar group.

24. The solution as defined in claim 22 wherein said compound in ($a^1$) or ($b^1$) is present in an amount ranging from 1 to 100 parts per million parts of the solution.

25. The solution as defined in claim 22 wherein said compound in ($c^1$) is present in an amount ranging from at least one part per million parts of the solution to saturation of the solution.

26. The solution as defined in claim 16, wherein:

said reducing agent comprises formaldehyde;

said stabilizer is selected from the group consisting of mercuric chloride, phenyl mercuric acetate and a mixture thereof; and said accelerator comprises potassium ferrocyanide.

27. An article of manufacture comprising a substrate having an essentially stress-free copper coat deposited from the solution of claim 16.

28. An article of manufacture comprising a substrate having an essentially stress-free copper coat deposited from the solution of claim 26.

29. An article of manufacture comprising a substrate and a stress-free copper deposit on at least one surface thereof, deposited from an electroless copper plating solution comprising:

(a) a source of cupric ions;

(b) a reducing agent for said cupric ions;

(c) a complexing agent for the solution selected from the group consisting of (1) cyclohexendiaminetetraacetic acid, (2) a salt of (1), and (3) a mixture of the foregoing complexing agents;

(d) a stabilizer for the solution comprising a mercury compound; and (e) an accelerator for the solution comprising a water-soluble compound containing a cyanide radical complexed with a metal selected from Group VIII of the Periodic Table of Elements.

30. The article as defined in claim 29 wherein the accelerator compound contains a radical selected from the group consisting of hexacyanoferrate (II), hexacyannoferrate (III), and mixtures thereof.

31. The article as defined in claim 29 wherein said accelerator is present in an amount ranging from about $1.5\times10^{-5}$ to about $1.2\times10^{-1}$ moles per liter of the solution, calculated as the metal with which the cyanide radical is complexed.

32. The article as defined in claim 29 wherein the metal is selected from the group consisting of iron, iridium and rhenium.

33. The article as defined in claim 29 wherein said reducing agent comprises formaldehyde.

34. The article as defined in claim 30 wherein the accelerator compound is in the form of a salt of a member selected from the group consisting of alkali metal, alkaline earth metal and ammonium.

35. The article as defined in claim 29 wherein said mercury compound is one selected from the group consisting of ($a^1$) a covalent mercury compound corresponding to the formula R—Hg—R′, where R is a covalently bonded organic radical selected from the group of alkyl, cycloalkyl, aryl, alkaryl, aralalkyl, alkoxy, aryloxy, and heterocyclic radicals and R′ is the same as R or a polar group selected from the groups of $—NO_2$, $—SO_2OH$ and alkali metal salts thereof, —COOH and alkali metal salts thereof, $—NH_2$, —CN and halide; ($b^1$) phenyl mercuric acetate; ($c^1$) a mercury compound capable of yielding mercury ions in the solution; and ($d^1$) a mixture of any of the foregoing.

36. The article as defined in claim 35 wherein in ($a^1$) said R′ is a polar group.

37. The article as defined in claim 35 wherein said compound in ($a^1$) or ($b^1$) is present in an amount ranging from 1 to 100 parts per million parts of the solution.

38. The article as defined in claim 35 wherein said compound in ($c^1$) is present in an amount ranging from at least one part per million parts of the solution to saturation of the solution.

39. The article as defined in claim 29, wherein:

said reducing agent comprises formaldehyde;

said complexing agent comprises a salt of ethylenediaminetetraacetic acid;

said stabilizer is selected from the group consisting of mercuric chloride, phenyl mercuric acetate and a mixture thereof; and said accelerator comprises potassium ferrocyanide.

40. The article as defined in claim 29 in the form of a printed circuit board having ductile copper conductors.

41. The printed circuit board of claim 40 having copper plated through-holes.

* * * * *